US012421640B2

(12) United States Patent
Rodriguez Munoz et al.

(10) Patent No.: US 12,421,640 B2
(45) Date of Patent: Sep. 23, 2025

(54) COMMERCIAL LAUNDRY APPLIANCE SYSTEM AND METHOD OF TRACKING ADDITIVE USAGE

(71) Applicant: Haier US Appliance Solutions, Inc., Wilmington, DE (US)

(72) Inventors: Jose Efren Rodriguez Munoz, Louisville, KY (US); Anna Rudek, Gainesville, FL (US); Reese Rapin, Mason, OH (US); Carrie Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 48 days.

(21) Appl. No.: 18/529,696

(22) Filed: Dec. 5, 2023

(65) Prior Publication Data

US 2025/0179712 A1 Jun. 5, 2025

(51) Int. Cl.

| | |
|---|---|
| ***D06F 31/00*** | (2006.01) |
| ***D06F 33/32*** | (2020.01) |
| ***D06F 34/05*** | (2020.01) |
| ***D06F 34/14*** | (2020.01) |
| ***D06F 39/02*** | (2006.01) |
| *D06F 103/00* | (2020.01) |
| *D06F 103/60* | (2020.01) |
| *D06F 105/58* | (2020.01) |

(52) U.S. Cl.

CPC ..... *D06F 34/14* (2020.02); *D06F 31/00* (2013.01); *D06F 33/32* (2020.02); *D06F 34/05* (2020.02); *D06F 39/022* (2013.01); *D06F 2103/00* (2020.02); *D06F 2103/60* (2020.02); *D06F 2105/58* (2020.02)

(58) Field of Classification Search

None

See application file for complete search history.

(56) References Cited

U.S. PATENT DOCUMENTS

| | | | |
|---|---|---|---|
| 11,624,140 B2 | 4/2023 | Alexander et al. | |
| 2022/0154379 A1* | 5/2022 | Rodriguez | D06F 34/05 |

FOREIGN PATENT DOCUMENTS

| | | | |
|---|---|---|---|
| CN | 105671876 | B | 11/2018 |
| CN | 113435976 | A | 9/2021 |
| CN | 110895748 | B | 5/2023 |
| EP | 2354290 | B1 | 10/2020 |
| WO | WO2022068951 | A1 | 4/2022 |

* cited by examiner

*Primary Examiner* — Levon J Shahinian

(74) *Attorney, Agent, or Firm* — Dority & Manning, P.A.

(57) ABSTRACT

A laundry appliance system includes a main server, a plurality of laundry appliances operatively connected with the main server, and a controller configured to perform an operation. The operation includes receiving a plurality of signals from the plurality of laundry appliances, the plurality of signals including a first remaining quantity of laundry additive within the first laundry appliance and a second remaining quantity of laundry additive within the second laundry appliance; determining a total amount of laundry additive required to fill each of the plurality of laundry appliances to a predetermined maximum fill level; and generating a notification in response to determining the total amount of laundry additive required to fill each of the plurality of laundry appliances, the notification including the total amount of required laundry additive.

18 Claims, 3 Drawing Sheets

COMMERCIAL LAUNDRY APPLIANCE SYSTEM AND METHOD OF TRACKING ADDITIVE USAGE

FIELD OF THE INVENTION

The present subject matter relates generally to laundry treatment appliance systems, and more particularly to additive measurement and tracking within commercial laundry appliances.

BACKGROUND OF THE INVENTION

Laundry appliances generally include washing machine appliances and dryer appliances. In recent years, it has become increasingly popular to provide features and methods that allow such laundry appliances to communicate with owners. For instance, an owner may configure a virtual account to pair with a particular laundry appliance. Subsequently, the virtual account may be able to receive notifications regarding the status or completion of a laundry cycle (e.g., wash cycle, dry cycle, etc.).

Some laundry appliances are publicly available, such as commercial laundry appliances available for rent or temporary use. For example, such multiple laundry appliances may be installed in a laundromat, dormitory, or apartment building, etc. As a result, such laundry appliances will often be used by multiple people throughout a single day. Moreover, owners of such laundry appliances are often not present at the location or locations of the appliances. Thus, when users continually use the appliances, owners are usure of detergent levels or requirements. Existing techniques for monitoring additive levels have several drawbacks. For instance, owners must hire full time staff to maintain additive levels. For another example, owners must make frequent trips to laundromats while guessing at a required amount of additive levels.

Accordingly, a laundry appliance system which obviates one of more of the above-mentioned drawbacks would be beneficial. In particular, a laundry appliance system with improved additive tracking and reporting would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry appliance system is provided. The laundry appliance system may include a main server including a wireless connection module and a memory; a plurality of laundry appliances operatively connected with the main server, the plurality of laundry appliances including a first laundry appliance, the first laundry appliance configured to store a laundry additive, the first laundry appliance being remotely connected with the main server; and a second laundry appliance, the second laundry appliance configured to store the laundry additive, the second laundry appliance being remotely connected with the main server. The laundry appliance system may further include a controller operably coupled with the first laundry appliance, the second laundry appliance, and the memory, the controller configured to perform an operation. The operation may include receiving a plurality of signals from the plurality of laundry appliances, the plurality of signals including a first signal from the first laundry appliance and a second signal from the second laundry appliance, the first signal including a first remaining quantity of the laundry additive within the first laundry appliance and the second signal including a second remaining quantity of the laundry additive within the second laundry appliance; determining a total amount of laundry additive required to fill each of the plurality of laundry appliances to a predetermined maximum fill level; and generating a notification in response to determining the total amount of laundry additive required to fill each of the plurality of laundry appliances, the notification including the total amount of required laundry additive.

In another exemplary aspect of the present disclosure, a method of operating a laundry appliance system is provided. The laundry appliance system may include a main server including a memory and a plurality of laundry appliances operatively connected with the main server. The method may include receiving a plurality of signals from the plurality of laundry appliances, the plurality of signals including a first signal from a first laundry appliance and a second signal from a second laundry appliance, the first signal including a first remaining quantity of the laundry additive within the first laundry appliance and the second signal including a second remaining quantity of the laundry additive within the second laundry appliance; determining a total amount of laundry additive required to fill each of the plurality of laundry appliances to a predetermined maximum fill level; and generating a notification in response to determining the total amount of laundry additive required to fill each of the plurality of laundry appliances, the notification including the total amount of required laundry additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
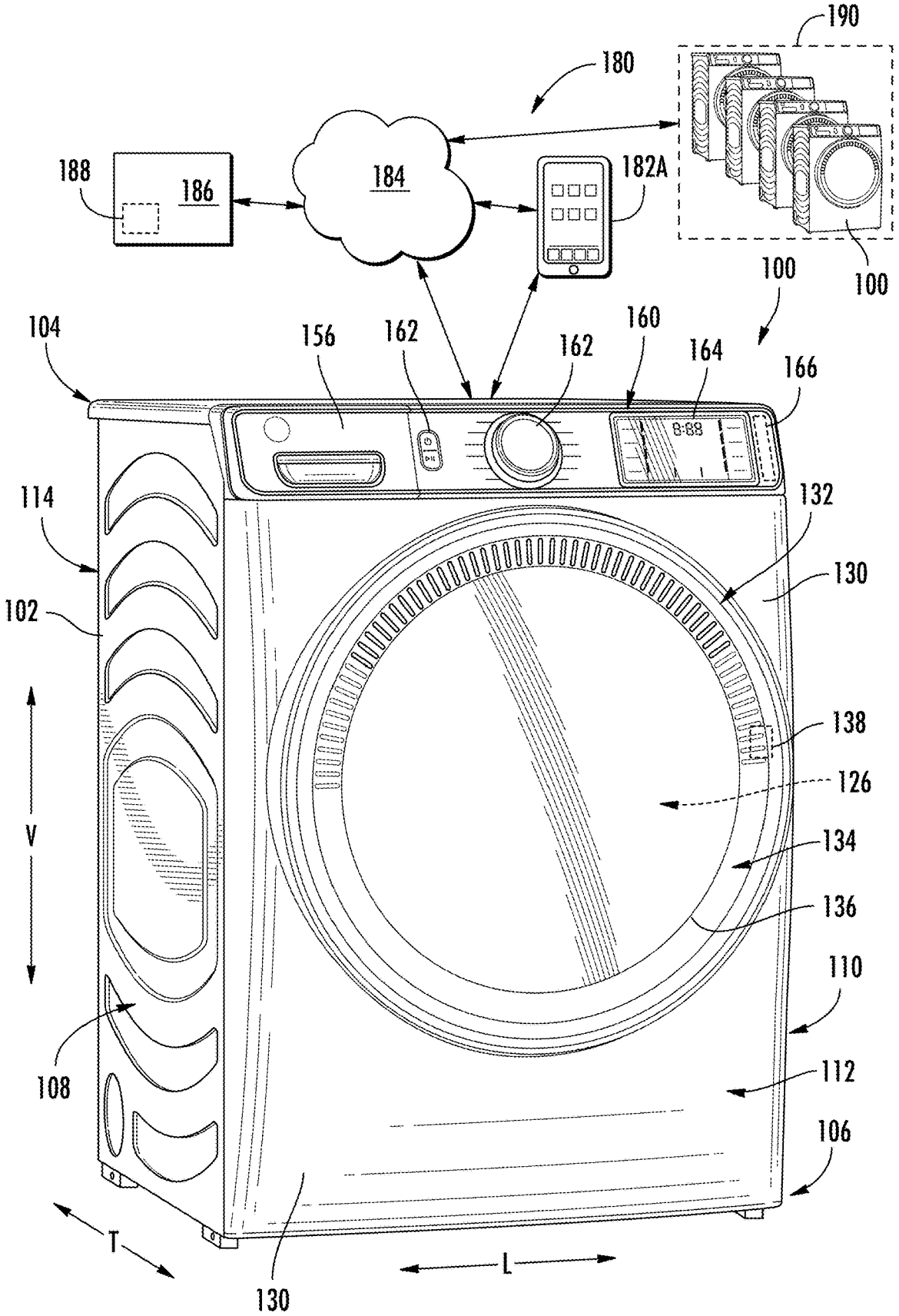
FIG. 1 provides a perspective view of an exemplary laundry appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
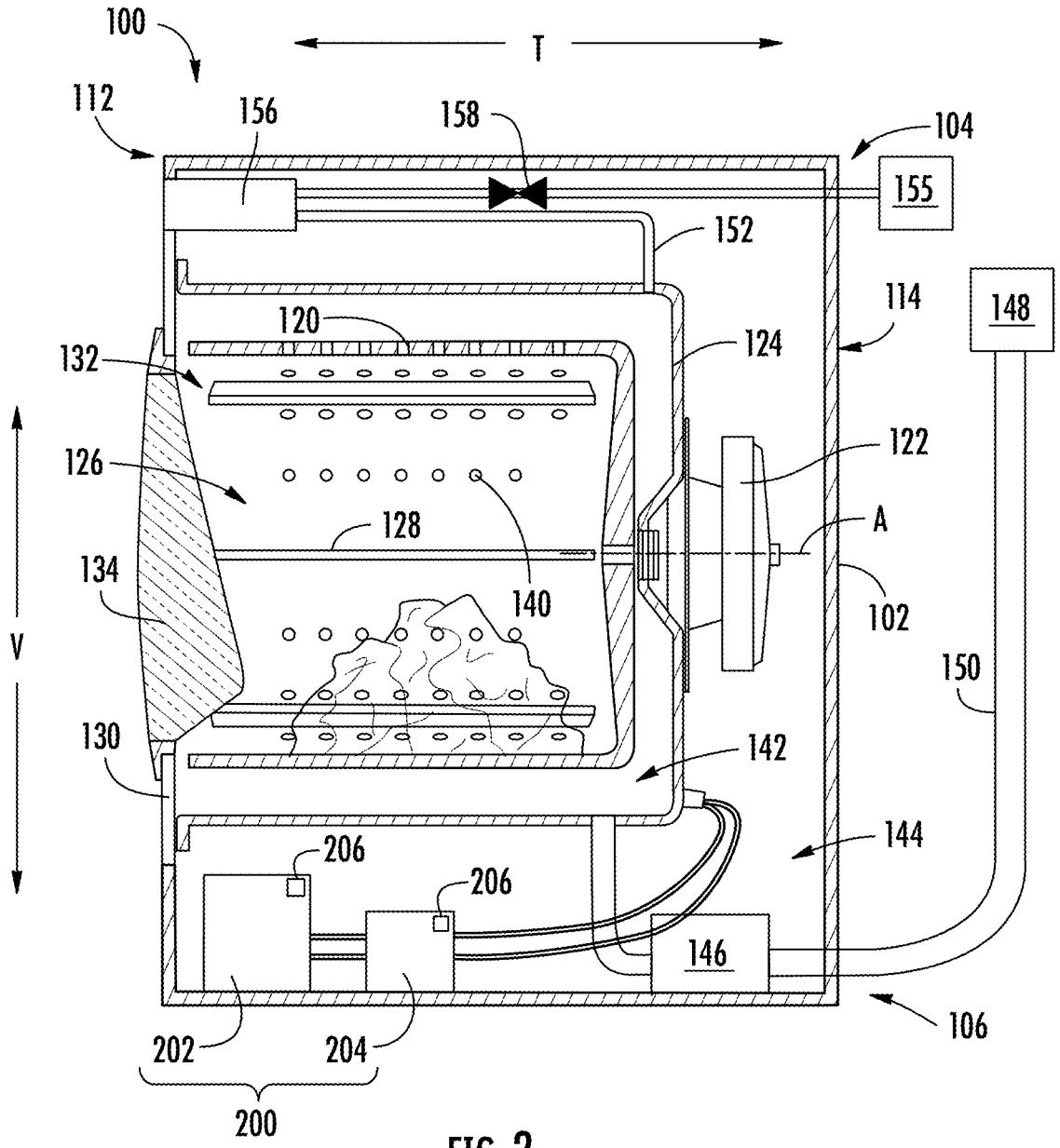
FIG. 2 provides a side cross-sectional view of the exemplary laundry appliance of FIG. 1.

Referring now to the figures, an exemplary laundry appliance that may be used to implement aspects of the present disclosure will be described. Specifically, FIG. 1 is a perspective view of an exemplary laundry appliance provided as a horizontal axis washing machine appliance 100. FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a laundry or wash chamber 126 that is configured for receipt of articles for laundering (e.g., washing). The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present disclosure to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 or door 134 for selectively locking door 134 in the closed position or confirming that the door is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present disclosure.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, or other fluid additives, e.g., via spout 152 or detergent drawer 156. One or more valves (e.g., water supply valve 158) can be controlled by washing machine appliance 100 to provide for filling wash basket 120 to the appropriate level for the amount of articles being washed or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, or rinsed, the user can remove the articles from wash basket 120, e.g., by opening door 134 and reaching into wash basket 120 through opening 132.

Referring again to FIG. 1, washing machine appliance 100 may include a control panel 160 that may represent a general-purpose Input/Output ("GPIO") device or functional block for washing machine appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads. Additionally, washing machine appliance 100 may include a display 164, such as a digital or analog display device generally configured to provide visual feedback regarding the operation of washing machine appliance 100. For example, display 164 may be provided on control panel 160 and may include one or more status lights, screens, or visible indicators. According to exemplary embodiments, user input devices 162 and display 164 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Washing machine appliance 100 may further include or be in operative communication with a processing device or a controller 166 that may be generally configured to facilitate appliance operation. In this regard, control panel 160, user input devices 162, and display 164 may be in communication with controller 166 such that controller 166 may receive control inputs from user input devices 162, may display information using display 164, and may otherwise regulate operation of washing machine appliance 100. For example, signals generated by controller 166 may operate washing machine appliance 100, including any or all system components, subsystems, or interconnected devices, in response to the position of user input devices 162 and other control commands. Control panel 160 and other components of washing machine appliance 100 may be in communication with controller 166 via, for example, one or more signal lines or shared communication busses. In this manner, Input/Output ("I/O") signals may be routed between controller 166 and various operational components of washing machine appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 166 may be constructed without using a microprocessor, e.g., using a combination of discrete analog or digital logic circuitry (such as switches, amplifiers, integrators, comparators, flip-flops, OR gates, and the like) to perform control functionality instead of relying upon software.

Controller 166 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor of controller 166 or may be included onboard within such a processor. In addition, these memory devices can store information or data accessible by the one or more processors of controller 166, including instructions that can be executed by the one or more processors. It should be appreciated that the instructions can be software written in any suitable programming language or can be implemented in hardware. Additionally, or alternatively, the instructions can be executed logically or virtually using separate threads on one or more processors.

For example, controller 166 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 166 as disclosed herein is capable of and may be operable to perform one or more methods, method steps, or portions of methods of appliance operation.

The memory devices of controller 166 may also store data that can be retrieved, manipulated, created, or stored by the one or more processors or portions of controller 166. The data can include, for instance, data to facilitate performance of methods described herein. The data can be stored locally (e.g., on controller 166) in one or more databases or may be split up so that the data is stored in multiple locations. In addition, or alternatively, the one or more database(s) can be connected to controller 166 through any suitable network(s), such as through a high bandwidth local area network (LAN) or wide area network (WAN). In this regard, for example, controller 166 may further include a communication module or interface that may be used to communicate with one or more other component(s) of washing machine appliance 100, controller 166, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring again to FIG. 1, a schematic diagram of an external communication system 180 will be described according to an exemplary embodiment of the present subject matter. In general, external communication system 180 is configured for permitting interaction, data transfer, and other communications between multiple discrete devices, such as a laundry appliance or more remote user devices. For example, this communication may be used to provide and receive operating parameters, user instructions or notifications, user preferences, or any other suitable information for engagement with washing machine appliance 100. In addition, it should be appreciated that external communication system 180 may be used to transfer data or other information to improve user interaction with laundry appliance or one or more remote user devices.

For example, external communication system 180 may permit controller 166 of washing machine appliance 100 to communicate with a separate device external to washing machine appliance 100, referred to generally herein as a remote user device 182A (e.g., of an owner or administrator having an owner account). As described in more detail below, these communications may be facilitated using a wired or wireless connection, such as via a network 184. In general, remote user device 182A may be any suitable device separate from washing machine appliance 100 that is configured with an owner account to provide or receive communications, information, data, or commands from a user. In this regard, remote user device 182A may be, for example, a personal phone, a smartphone, a tablet, a laptop or personal computer, a wearable device, a smart home system, or another mobile or external device.

Optionally, the remote user device 182A may include or be able to access a software application for interacting with the laundromat appliances. For instance, the remote user device 182A may be provided or associated with a particular user profile (e.g., an owner account) to interact with and operate each of the laundromat appliances.

In addition, a remote server 186 may be in communication with washing machine appliance 100 or remote user device 182A through network 184. In this regard, for example, remote server 186 may be a cloud-based server 186, and is thus located at a distant location, such as in a separate state, country, etc.

Generally remote server 186 may include a controller 188 (e.g., including one or more suitable processing devices, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. Controller 188 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor of controller 188 or may be included onboard within such processor. In addition, these memory devices can store information or data accessible by the one or more processors of the controller 188, including instructions that can be executed by the one or more processors. It should be appreciated that the instructions can be software written in any suitable programming language or can be implemented in hardware. Additionally, or alternatively, the instructions can be executed logically or virtually using separate threads on one or more processors.

For example, controller 188 may be operable to execute programming instructions or micro-control code associated with operation of or engagement with washing machine appliance 100. In this regard, the instructions may be software or any set of instructions that when executed by the processing device, cause the processing device to perform operations, such as running one or more software applications, displaying or directing a user interface, receiving user input, processing user input, transmitting a notification signal, etc. Moreover, it should be noted that controller 188 as disclosed herein is capable of and may be operable to perform one or more methods, method steps, or portions of methods of appliance operation. For example, in some embodiments, these methods may be embodied in programming instructions stored in the memory and executed by controller 188.

The memory devices of controller 188 may also store data that can be retrieved, manipulated, created, or stored by the one or more processors or portions of controller 188. The data can include, for instance, data to facilitate performance of methods described herein. As an example, the data may include a notification table that is associated with a particular appliance and in which guest accounts or addresses may be recorded and subsequently referenced in order to transmit notification signals corresponding to operation of the particular appliance 100. As will be described in detail below, conditions or limits to the notification table may be specified by an owner (e.g., via an owner account).

The data can be stored locally (e.g., on controller 188) in one or more databases or may be split up so that the data is stored in multiple locations. In addition, or alternatively, the one or more database(s) can be connected to controller 166 through any suitable network(s), such as through a high bandwidth local area network (LAN) or wide area network (WAN). In this regard, for example, controller 188 may further include a communication module or interface that may be used to communicate with washing machine appliance 100, controller 166, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

According to an exemplary embodiment, remote user device 182A may communicate with remote server 186 over network 184, such as the Internet (e.g., arrow 310), to transmit/receive data or information, provide user inputs, receive user notifications or instructions, interact with or control washing machine appliance 100, etc. In addition, remote user device 182A and remote server 186 may communicate with washing machine appliance 100 (e.g., arrow 340) to communicate similar information.

In general, remote user device 182A may be any suitable device separate from washing machine appliance 100 that is configured with a user account or profile to provide or receive communications, information, data, or commands from a user (e.g., washing commands for a commercial appliance). In this regard, remote user device 182A may be, for example, a personal phone, a smartphone, a tablet, a laptop or personal computer, a wearable device, a smart home system, or another mobile or external device.

Optionally, the remote user device 182A may include or be able to access a software application for interacting with the laundromat appliances. For instance, the remote user device 182A may be provided or associated with a particular user profile (e.g., a consumer account) to interact with and operate each of the laundromat appliances. Such a profile may include physical or digital wallets that contain credits (e.g., coupons, tokens, or digital currency) for performing one or more cycles of the various washers and dryers within a laundromat. Remote server 186 may be in communication with remote user device 182A through network 184.

In general, communication between washing machine appliance 100, remote user device 182A, remote server 186, or other user devices or appliances may be carried using any type of wired or wireless connection and using any suitable type of communication network, non-limiting examples of which are provided below. For example, remote user device 182A may be in direct or indirect communication with washing machine appliance 100 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), or protection schemes (e.g., VPN, secure HTTP, SSL).

External communication system 180 is described herein according to an exemplary embodiment of the present disclosure. However, it should be appreciated that the exemplary functions and configurations of external communication system 180 provided herein are used only as examples to facilitate description of aspects of the present disclosure. System configurations may vary, other communication devices may be used to communicate directly or indirectly with one or more associated appliances, other communication protocols and steps may be implemented, etc. These variations and modifications are contemplated as within the scope of the present disclosure.

While described in the context of a specific embodiment of horizontal axis washing machine appliance 100, using the teachings disclosed herein it will be understood that horizontal axis washing machine appliance 100 is provided by way of example only. Other laundry appliances having different configurations, different appearances, or different features may also be utilized with the present subject as well. Such laundry appliances may include a vertical axis washing machine appliance, dryer appliance, combined washer/dryer appliance, etc., as would be understood in light of the present disclosure.

Referring still to FIG. 1, washing machine appliance 100 may be utilized as a commercial washer in a laundromat or another commercial setting. In this regard, as used herein, discussion of the use of laundry appliances in a commercial setting may generally refer to the use of the appliance in any location where one or more appliances are provided for temporary use by consumers or users who do not own the appliance(s). These commercial settings may include laundromats that include a large number of washers and dryers that are configured for pay-per-use operation, e.g., via cash, coins, digital currency, or other forms of payment. Additionally or alternatively, these commercial settings may include rental properties (e.g., short-term or long-term rental properties) in which a temporary, non-owner user or guest will have access to the appliance(s) for only a limited (e.g., predetermined) period of time.

For example, as shown in FIG. 1, washing machine appliance 100 may be located in a commercial environment (e.g., as identified generally by reference numeral 190) along with other washing machine appliances, dryer appliances, etc. In some embodiments, each of the laundry appliances (e.g., washers or dryers) includes an appliance identifier or designation to identify a particular laundry appliance at a remote user device 182A or remote server 186. Such an identifier may be embedded or stored (e.g., within a corresponding controller 166 to be displayed at the display 164). Additionally or alternatively, the appliance identifier may be encoded in a bar code, such as a QR code applied or fixed to a portion of the appliance (e.g., on the corresponding cabinet or control panel). Further additionally or alternatively, the appliance identifier may include a serial number or MAC address of the washing machine appliance. Yet further additionally or alternatively, the appliance identifier may include a predetermined access code for adding a guest account to the notification table associated with a particular laundry appliance. Such identifiers may assist owners in receiving and sorting information (e.g., detergent levels, etc.) as they pertain to specific appliances.

Laundry treatment appliance 100 may include one or more bulk tanks or storage tanks 200 (FIG. 2). For instance, bulk tanks 200 may include a detergent bulk tank 202 and a booster bulk tank 204. As would be understood, detergent bulk tank 202 may be configured to store a laundry detergent (e.g., such as a liquid laundry detergent) therein. The stored detergent may then be selectively released from detergent bulk tank 202 into wash tub 124 according to a dosage amount for particular washing cycles. Booster bulk tank 204 may be configured to selectively hold an additional or alternative laundry additive. For instance, booster bulk tank 204 may selectively store a bleach, a scent booster, fabric softener, a powder detergent, one or more detergent pods, a stain remover, a color protector or enhancer, or the like. Each of bulk tanks 200 may be connected to wash tub 124 via a supply line or conduit (e.g., a hose). Additionally or alternatively, one or more pumps may be utilized to pump the contents of bulk tanks 200 into wash tub 124.

Although bulk tanks 200 are shown in FIG. 2 as being located at a bottom of appliance 100, it should be understood that the location of bulk tanks 200 is provided by way of example, and that each of detergent bulk tank 202 and booster bulk tank 204 may be provided at any suitable location within cabinet 102 (e.g., at or near detergent drawer 156), and the disclosure is not limited to the examples provided herein. Further still, bulk tanks 200 may be provided outside of appliance 100 (e.g., outside of cabinet 102) and connected thereto via one or more additional conduits. Additionally or alternatively, any suitable number of bulk tanks 200 may be incorporated, such as three or more bulk tanks.

Each bulk tank 200 may include a sensor 206. Hereinafter, a single sensor 206 will be described in detail with the understanding that the description may apply to each incorporated sensor. Generally, sensor 206 may sense a level of additive (e.g., liquid additive) contained within its respective bulk tank 200. In some embodiments, sensor 206 is in operable communication with controller 180. For instance, sensor 280 may communicate with a controller (e.g., controller 166) via one or more signals. In some embodiments, sensor 206 (or controller 166) includes a predetermined threshold level (e.g., to indicate the need for additional liquid to bulk tank 200). In particular, sensor 206 may detect if or when the liquid within bulk tank 200 is below the predetermined threshold level. The determined level of liquid may be transmitted to controller 166 whereby it is compared with the stored threshold level. Optionally, sensor 206 may be a two-position sensor. In other words, sensor 206 may either be "on" or "off," depending on a level of additive. It should be understood that sensor 206 may be any suitable sensor capable of determining a level of additive within bulk tank 200, such as an optical sensor, a float sensor, an infrared sensor, or the like, and the disclosure is not limited to those examples provided herein.

Figure 3:
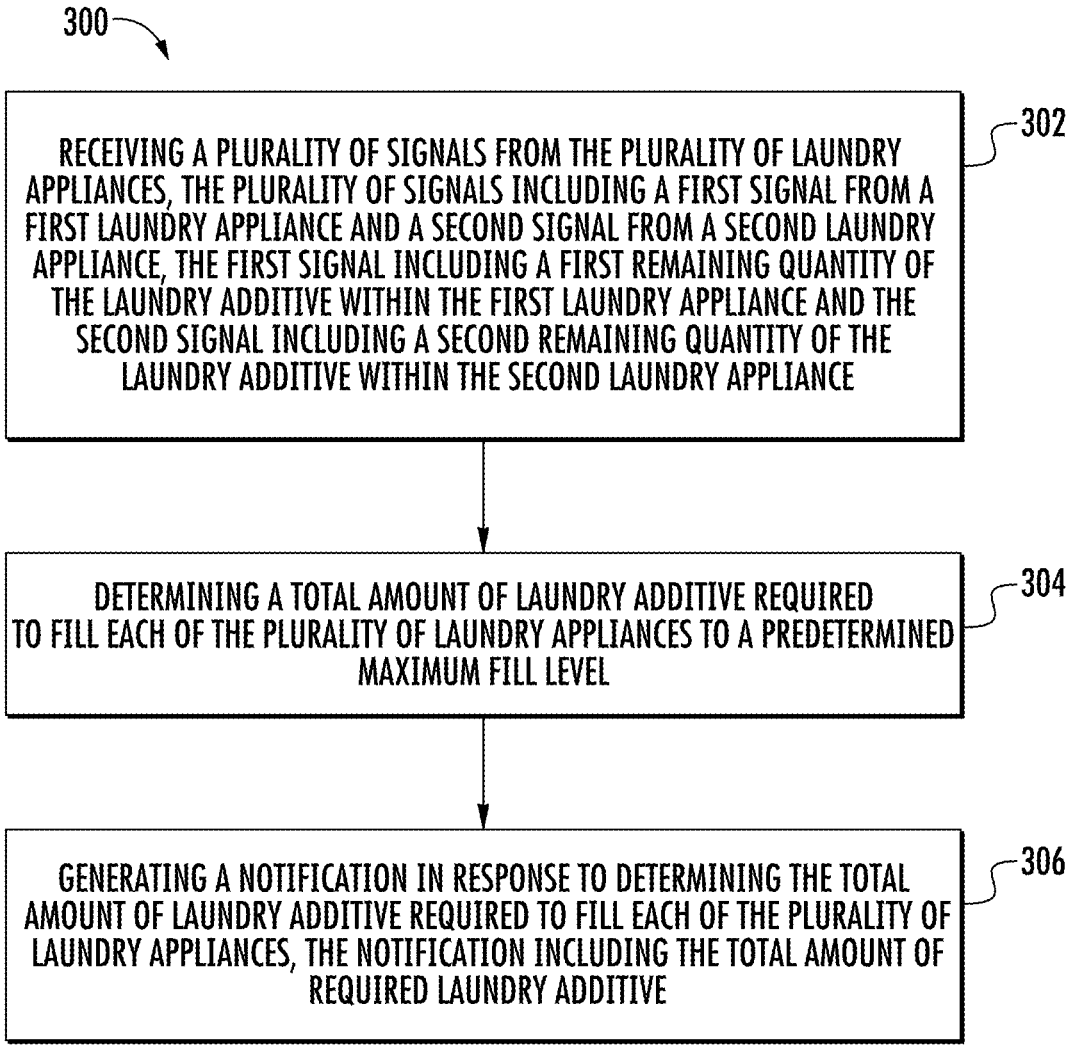
FIG. 3 provides a flow chart illustrating a method of operating a laundry appliance according to exemplary embodiments of the present disclosure.

Now that the general descriptions of an exemplary laundry treatment appliance (e.g., laundry treatment appliance 100) have been presented, FIG. 3 provides a method 300 of operating a laundry appliance system, such as laundry appliance system 190. For instance, method 300 may be applicable to any collection of laundry treatment appliances, including multiple groups of laundry treatment appliances provided in multiple separate physical locations. In exemplary embodiments, the various method steps as disclosed herein may be performed by controller 188, controller 166, and/or a separate, dedicated controller. FIG. 3 provides a flow chart illustrating a method of operating a laundry treatment appliance system including multiple appliances. Hereinafter, method 300 will be described with specific reference to FIG. 3.

At step 302, method 300 may include receiving a plurality of signals from the plurality of laundry appliances, the plurality of signals including a first signal from a first laundry appliance and a second signal from a second laundry appliance. The first signal may include a first remaining quantity of laundry additive within the first laundry appliance and the second signal may include a second remaining quantity of the laundry additive within the second laundry appliance.

In detail, method 300 may include receiving signals from each connected laundry appliance within a user's ownership or control. Thus, as would be understood, method 300 is not limited to just the first and second laundry appliances. For instance, at step 302, the plurality of signals may be received from any suitable number of appliances including remaining quantities of additive for each appliance. As mentioned above, the plurality of appliances may be distributed or allocated across multiple physical locations, such as two or more separate laundromats.

One or more of the plurality of laundry appliances may include a storage or bulk tank. For example, each connected appliance includes a storage tank (e.g., storage tank 200) provided on board in which the laundry additive is stored. The storage tank may be monitored by a sensor, such as a level sensor. As described above, the sensor may be a liquid level sensor configured to monitor or sense a level of liquid (e.g., additive) provided within the storage tank. Thus, for example, receiving the first signal includes receiving a first level signal from a first sensor provided within a first storage tank of the first laundry appliance. As would be expected, the plurality of signals may include a second level signal from a second sensor provided within a second storage tank of the second laundry appliance, and so on. The level signals may first be received within an on board controller (e.g., controller 166) of each respective laundry appliance. The signal may then be decoded, translated, or otherwise converted into a liquid level within the storage tank. The signal may then be transmitted to a controller (e.g., controller 188) provided within a main server (e.g., server 186).

According to another embodiment, the first signal may include one or more data packets. For instance, receiving the first signal may include receiving a first data packet from the first laundry appliance. The first data packet may include usage statistics from the first laundry appliance related to a dispensation of the additive. According to some examples, the laundry appliance includes a flow sensor positioned at an outlet of the bulk tank. The flow sensor may monitor the dispensation of additive from the bulk tank to the tub. Thus, the data packet may include information such as dispensed amounts of the additive over a predetermined length of time. The data packet may first be received by the on board controller. The on board controller may decode, translate, or otherwise convert the information into a total dispensed amount of additive over the predetermined length of time. As would be understood, additional laundry treatment appliances (e.g., such as the second laundry appliance, a third laundry appliance, etc.) may transmit similar data or usage packets as part of the plurality of signals.

At step 304, method 300 may include determining a total amount of laundry additive required to fill each of the plurality of laundry appliances to a predetermined maximum fill level. The predetermined maximum fill level may be a total volume (e.g., in liters, gallons, etc.) of the bulk tank provided within the laundry appliance. Thus, a total predetermined maximum fill level of laundry additive may be each total volume of each laundry appliances added together. The predetermined maximum fill level may be stored within the controller (e.g., controller 188). Additionally or alternatively, the predetermined maximum fill level may be routinely calculated upon receipt of the plurality of signals. For instance, in the event new machines are added to the plurality of laundry appliances, method 300 may calculate a new maximum fill level required for each included laundry appliance.

The total amount of additive required to fill each of the plurality of laundry appliances may be determined based on the plurality of signals received from the plurality of laundry appliances. Referring to the example provided above, the plurality of signals includes a remaining amount of additive within each respective storage or bulk tank. Thus, the total amount of additive required may be determined by subtracting each remaining quantity of the laundry additive within each storage tank from a total capacity of each storage tank. The total capacity of each storage tank may be a predetermined or known number or amount (e.g., in gallons, liters, etc.). Accordingly, for each connected laundry appliance, the received signal may be subtracted from the known total capacity to obtain, calculate, or otherwise determine a deficit amount. For example, a first deficit amount is determined for the first laundry appliance, a second deficit amount is determined for the second laundry appliance, and so on. Each determined deficit amount may then be added together to determine the total amount of additive required to fill each laundry appliance to the predetermined maximum fill level of laundry additive.

At step 306, method 300 may include generating a notification in response to determining the total amount of laundry additive required to fill each of the plurality of laundry appliances. In detail, the notification may include the total amount of required laundry additive. The total amount of required laundry additive may include each connected laundry appliance (e.g., within each group at each location). The notification may display the total amount of laundry additive required as a lump sum amount (e.g., in gallons, liters, etc.). Additionally or alternatively, the total amount of laundry additive required may be divided and displayed per group of laundry appliances. For instance, if the plurality of laundry appliances is split into three groups at three different locations, the total amount of laundry additive may be divided into a required amount for each group (e.g., each location).

The notification may be displayed or presented to a user (e.g., an owner of the plurality of laundry appliances). For instance, the notification, including the total amount of laundry additive required to fill each of the plurality of laundry appliances, may be transmitted to a virtual portal accessible to the user. The virtual portal may be accessible via a remote application (app) such as a mobile app. Additionally or alternatively, the notification may be directly transmitted to a mobile device or other remote connected device. For instance, the notification may be "pushed" as an instant notification to a mobile smartphone of the user. Accordingly, the user may easily check on a required amount of the laundry additive before traveling to the location of the laundry appliances.

In some additional or alternative embodiments, the virtual portal may be connected with a shopping service. For instance, the user may, within the portal, place an order for the required amount of laundry additive. Further still, the user may institute an automatic trigger to initiate a purchase of the required amount of laundry additive. The automatic trigger may be based on a predetermined amount. For instance, when the required amount of laundry additive reaches or exceeds a predetermined amount, the automatic trigger may initiate a purchase for a predetermined amount of the laundry additive. The predetermined amount of the laundry additive may be greater than or equal to the determined total amount of laundry additive required to fill each of the plurality of laundry appliances to the predetermined maximum fill level.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance system comprising:

a main server comprising a wireless connection module and a memory;

a plurality of laundry appliances operatively connected with the main server, the plurality of laundry appliances comprising:

a first laundry appliance; the first laundry appliance configured to store a laundry additive, the first laundry appliance being remotely connected with the main server; and a second laundry appliance; the second laundry appliance configured to store the laundry additive, the second laundry appliance being remotely connected with the main server; and a controller operably coupled with the first laundry appliance, the second laundry appliance, and the memory, the controller configured to perform an operation, the operation comprising:

receiving a plurality of signals from the plurality of laundry appliances, the plurality of signals comprising a first signal from the first laundry appliance and a second signal from the second laundry appliance, the first signal comprising a first remaining quantity of the laundry additive within the first laundry appliance and the second signal comprising a second remaining quantity of the laundry additive within the second laundry appliance;

determining a total amount of laundry additive required to fill each of the plurality of laundry appliances to a predetermined maximum fill level; and generating a notification in response to determining the total amount of laundry additive required to fill each of the plurality of laundry appliances, the notification comprising the total amount of required laundry additive.

2. The laundry appliance system of claim 1, wherein determining the total amount of additive required to fill each of the plurality of laundry appliances comprises:

subtracting the first remaining quantity of the laundry additive within the first laundry appliance from a total capacity of the first laundry appliance to obtain a first deficit amount;

subtracting the second remaining quantity of the laundry additive within the second laundry appliance from a total capacity of the second laundry appliance to obtain a second deficit amount; and adding the first deficit amount and the second deficit amount.

3. The laundry appliance system of claim 1, wherein the plurality of laundry appliances comprises a first group of laundry appliances provided at a first physical location and a second group of laundry appliances provided at a second physical location.

4. The laundry appliance system of claim 1, wherein each of the plurality of laundry appliances comprises a respective storage tank configured to store the laundry additive.

5. The laundry appliance system of claim 4, further comprising a first liquid level sensor at a first storage tank provided within the first laundry appliance and a second liquid level sensor at a second storage tank provided within the second laundry appliance.

6. The laundry appliance system of claim 5, wherein receiving the first signal from the first laundry appliance and the second signal from the second laundry appliance comprises:

receiving a first level signal from the first liquid level sensor and a second level signal from the second liquid level sensor.

7. The laundry appliance system of claim 1, wherein receiving the first signal from the first laundry appliance and the second signal from the second laundry appliance comprises:

receiving a first usage packet from the first laundry appliance, the first usage packet comprising a plurality of dispensed amounts of the laundry additive over a predetermined length of time for the first laundry appliance; and receiving a second usage packet from the second laundry appliance, the second usage packet comprising a plurality of dispensed amounts of the laundry additive over a predetermined length of time for the second laundry appliance.

8. The laundry appliance system of claim 1, wherein generating the notification comprises:

displaying the notification within a virtual portal, the virtual portal being accessible via a connected remote device.

9. The laundry appliance system of claim 1, wherein the laundry additive comprises one or more of a liquid detergent, a liquid bleach, a powder detergent, a fabric softener, a scent booster, a stain remover, detergent pods, or color protector.

10. A method of operating a laundry appliance system, the laundry appliance system comprising a main server comprising a memory and a plurality of laundry appliances operatively connected with the main server, the method comprising:

receiving a plurality of signals from the plurality of laundry appliances, the plurality of signals comprising a first signal from a first laundry appliance and a second signal from a second laundry appliance, the first signal comprising a first remaining quantity of the laundry additive within the first laundry appliance and the second signal comprising a second remaining quantity of the laundry additive within the second laundry appliance;

determining a total amount of laundry additive required to fill each of the plurality of laundry appliances to a predetermined maximum fill level; and generating a notification in response to determining the total amount of laundry additive required to fill each of the plurality of laundry appliances, the notification comprising the total amount of required laundry additive.

11. The method of claim 10, wherein determining the total amount of additive required to fill each of the plurality of laundry appliances comprises:

subtracting the first remaining quantity of the laundry additive within the first laundry appliance from a total capacity of the first laundry appliance to obtain a first deficit amount;

subtracting the second remaining quantity of the laundry additive within the second laundry appliance from a total capacity of the second laundry appliance to obtain a second deficit amount; and adding the first deficit amount and the second deficit amount.

12. The method of claim 10, wherein the plurality of laundry appliances comprises a first group of laundry appliances provided at a first physical location and a second group of laundry appliances provided at a second physical location.

13. The method of claim 10, wherein each of the plurality of laundry appliances comprises a respective storage tank configured to store the laundry additive.

14. The method of claim 13, wherein the laundry appliance system further comprises a first liquid level sensor at a first storage tank provided within the first laundry appliance and a second liquid level sensor at a second storage tank provided within the second laundry appliance.

15. The method of claim 14, wherein receiving the first signal from the first laundry appliance and the second signal from the second laundry appliance comprises:

receiving a first level signal from the first liquid level sensor and a second level signal from the second liquid level sensor.

16. The method of claim 10, wherein receiving the first signal from the first laundry appliance and the second signal from the second laundry appliance comprises:

receiving a first usage packet from the first laundry appliance, the first usage packet comprising a plurality of dispensed amounts of the laundry additive over a predetermined length of time for the first laundry appliance; and receiving a second usage packet from the second laundry appliance, the second usage packet comprising a plurality of dispensed amounts of the laundry additive over a predetermined length of time for the second laundry appliance.

17. The method of claim 10, wherein generating the notification comprises:

displaying the notification within a virtual portal, the virtual portal being accessible via a connected remote device.

18. The method of claim 10, wherein the laundry additive comprises one or more of a liquid detergent, a liquid bleach, a powder detergent, a fabric softener, a scent booster, a stain remover, detergent pods, or color protector.

* * * * *